US006083027A

United States Patent [19]

Sato

[11] Patent Number: 6,083,027

[45] Date of Patent: Jul. 4, 2000

[54] CONNECTOR STRUCTURE FOR CONNECTING ELECTRIC APPLIANCE TO INSTRUMENT PANEL

[75] Inventor: Kei Sato, Shizuoka-ken, Japan

[73] Assignee: Yazaki Corporation, Tokyo, Japan

[21] Appl. No.: 09/281,004

[22] Filed: Mar. 30, 1999

[30] Foreign Application Priority Data

Mar. 31, 1998 [JP] Japan ..... 10-087135

[51] Int. Cl.[7] ..... H01R 4/50

[52] U.S. Cl. ..... 439/341; 439/376; 439/861

[58] Field of Search ..... 439/341, 881, 439/861, 376, 924.1

[56] References Cited

U.S. PATENT DOCUMENTS

| | | | |
|---|---|---|---|
| 3,969,796 | 7/1976 | Hodsdon et al. | 439/341 |
| 4,838,816 | 6/1989 | Matsusaka et al. | 439/861 |
| 5,148,353 | 9/1992 | Morgan et al. | 439/341 |
| 5,302,136 | 4/1994 | St. Germain et al. | 439/341 |
| 5,342,219 | 8/1994 | Onodera et al. | 439/861 |
| 5,476,392 | 12/1995 | Inaba et al. | 439/341 |
| 5,711,682 | 1/1998 | Maejima | 439/341 |

FOREIGN PATENT DOCUMENTS 6-325822 11/1994 Japan .

*Primary Examiner*—Neil Abrams
*Assistant Examiner*—Hae Moon Hyeon
*Attorney, Agent, or Firm*—Finnegan, Henderson, Farabow, Garrett & Dunner, L.L.P.

[57] ABSTRACT

A connector structure includes an electric appliance; a member to be mounted which is to be mounted with the electric appliance; a first connector provided on the electric appliance side; a second connector provided on the member to be mounted side; a retaining portion provided on the member to be mounted, the retaining portion serving as a rotating fulcrum when the electric appliance is mounted onto the member to be mounted; and an engaging portion provided at a position of the electric appliance opposing the retaining portion, the engaging portion supported by the retaining portion. In the construction, the second connector is located at a position spaced by a prescribed distance from the retaining portion of the member to be mounted. Furthermore, the electric appliance is rotated toward the member to be mounted using the retaining portion as a fulcrum so that one side terminals of the first connector and the other side terminals of the second connector can be freely contactable with each other.

12 Claims, 5 Drawing Sheets

CONNECTOR STRUCTURE FOR CONNECTING ELECTRIC APPLIANCE TO INSTRUMENT PANEL

BACKGROUND OF THE INVENTION

1. Field of the Invention

The present invention relates to a multipolar and miniaturized connector structure which has enabled, for example, a connector of an on-vehicle instrument panel side (wire harness side) and a connector of a meter side (gauge board side) to be easily interfitted with each other by the use of a small operating force.

2. Description of the Related Art

As this type of connector, there is one disclosed in Japanese Patent Application Laid-Open Publication No. 6-325822, illustrated in FIGS. 1A to 4. The connector 1 is constituted by a male connector housing 2 having a support shaft 2*a* protruded from both side surfaces thereof on which a lever 3 is rockably supported, and mounted through a bracket 4 on an inside panel 5*a* of an instrument panel for use on a vehicle so that the male connector housing 2 may be freely movable in back-and-forth directions toward or away from the inside panel 5*a*, and a female connector housing 6 having protruded from each side thereof fitting and fit-releasing projections 6*a*, 6*b* sliding in such a way as to clamp a corresponding one of a pair of arm portions 3*a*, 3*a* of the lever 3 to thereby enable the male connector housing 2 to be engaged with or disengaged from the interior of a hood 6*c*.

Below the female connector housing 6, there is provided a rail portion 9 which supports a slider 8 pivotally supported on a forward end portion of a screw member 7 so that the slider 8 may be freely movable in back-and-forth directions. Also, it is arranged that a bar-like slider abutment portion 3*b* of the lever 3 is accommodated in a recessed portion 8*a* of the slider 8. And, as illustrated in FIGS. 2 and 3, when rocking the lever 3 by the rotation of the screw member 7 in the back-and-forth directions of the male and female connector housings 2, 6, the engagement or disengagement between the male and female connector housings 2, 6 is effected through the projections 6*a*, 6*b* with a small force due to the lever action (assisting mechanism) of the lever 3.

It is to be noted that, as illustrated in FIG. 4, on a lower side of the inner side panel 5*a* of the instrument panel 5 there is mounted a meter (gauge board) M through a bolt, nut, etc.

However, in the above-described conventional connector 1, since the lever 3 is operated by rotating the screw member 7 with a machine tool such as a driver, a zone for operating the lever 3 becomes necessary, with the result that the entire connector structure has become large in size. Also, since separate screw members are used, respectively, for the screw member for interfitting the male and female connector housings 2 and 6 with each other and for a screw member for fixing the meter M to a lower side of the inner side panel 5*a* of the instrument panel 5, the interfitting and fixing operations were complex.

SUMMARY OF THE INVENTION

The present invention has been achieved with such points in mind.

It therefore is an object of the present invention to provide a connector structure which enables the connectors both on a member to be mounted side and on an electric appliance side to be interfitted with each other in a simple way and with a small force through the performance of a simple operation of mounting an electric appliance onto the member to be mounted side by rotating this electric appliance and enables the miniaturization of the entire structure.

To achieve the object, according to a first aspect of the present invention, there is provided a connector structure which comprises: an electric appliance; a member to be mounted which is to be mounted with the electric appliance; a first connector provided on the electric appliance side; a second connector provided on the member to be mounted side; a retaining portion provided on the member to be mounted, the retaining portion serving as a rotating fulcrum when the electric appliance is mounted onto the member to be mounted; and an engaging portion provided at a position of the electric appliance opposing the retaining portion, the engaging portion supported by the retaining portion, wherein the second connector is located at a position spaced by a prescribed distance from the retaining portion of the member to be mounted; wherein the first connector is provided at the position of the electric appliance opposing the second connector; and wherein when the electric appliance is mounted onto the member to be mounted, the electric appliance is rotated toward the member to be mounted using the retaining portion as a fulcrum so that one side terminals of the first connector and the other side terminals of the second connector can be freely contactable with each other.

In this connector structure, since at the time of mounting the electric appliance onto the member to be mounted the electric appliance is rotated toward the member to be mounted side using the retaining portion of the member to be mounted as a fulcrum whereby one side connector of the electric appliance side has been made freely interfittable with the other side connector of the member to be mounted side, the electric appliance itself serves as a lever function. Therefore, the both connectors are easily fitted together with a small force with the use of no spacial assisting mechanism and, even in the case of a multipolar connector, the both connectors are easily and reliably fitted to each other. Also, since it is sufficient to provide the retaining portion serving as the rotating fulcrum on the member to be mounted and to provide the engaging portion supported by the retaining portion on the electric appliance, it is possible to simplify and miniaturize the entire connector structure and, at the same time, to reduce the number of the parts used and thereby reduce the cost of the connector structure.

According to a second aspect of the present invention, as it depends from the first aspect, there is provided the connector structure, wherein the one side terminals are constituted by substantially plate-shaped male terminals each having a forward sharpened portion on one side thereof; wherein the other side terminals are constituted by female terminals each having a horizontally thrown U shaped forward end portion and having a bent elastic piece therein; and wherein when bringing these both terminals into contact with each other, the forward sharpened portions of the male terminals are fitted into the bent elastic pieces within the forward end portions of the female terminals from the openings of these forward end portions, thereby making the male terminals freely contactable therewith.

In this connector structure, when one end side of the male terminal of the connector of the electric appliance side is inserted into the horizontally thrown U shaped forward end portion of the female terminal of the connector of the member to be mounted side from the opening side thereof whereby the bent elastic piece within the forward end portion and the male terminal are brought into contact with each other, the male terminal is smoothly inserted into the forward end portion of the female terminal through the forward sharpened portion thereof. After the mutual contact therebetween, the state of contact between the both terminals is reliably maintained by the elastic urging force of the bent elastic piece.

BRIEF DESCRIPTION OF THE ACCOMPANYING DRAWINGS

The above and further objects and novel features of the present invention will more fully appear from the following detailed description when the same is read in conjunction with the accompanying drawings, in which.

DETAILED DESCRIPTION OF THE PREFERRED EMBODIMENTS

Figure 1A:
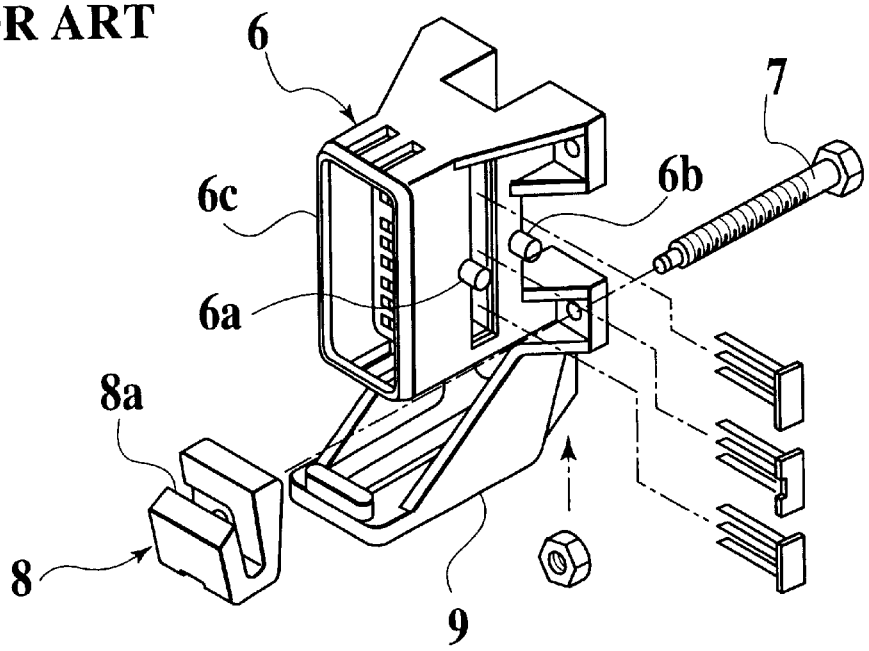
FIG.1A PRIOR ART
FIG. 1A is a perspective view illustrating a female connector housing side of a conventional connector structure.
Figure 1B:
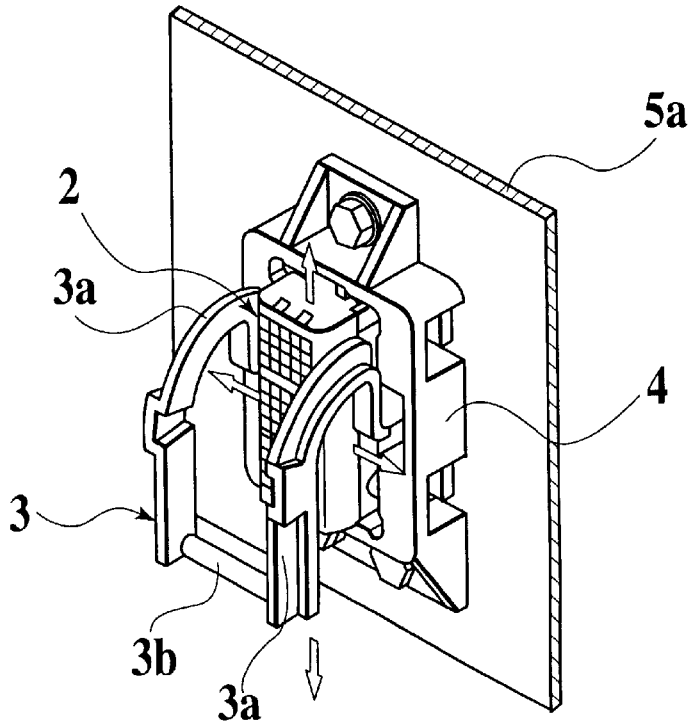
FIG.1B PRIOR ART
FIG. 1B is a perspective view illustrating a male connector housing side of the conventional connector structure.
Figure 2:
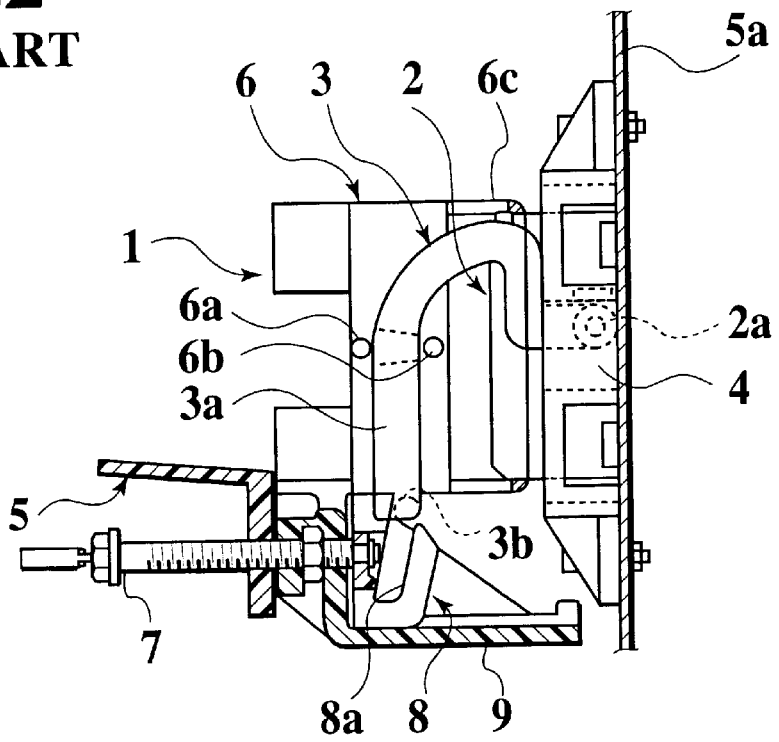
FIG.2 PRIOR ART
FIG. 2 is a side view illustrating partly in section a temporarily interfitted state between the male and female connector housings of the conventional connector structure.
Figure 3:
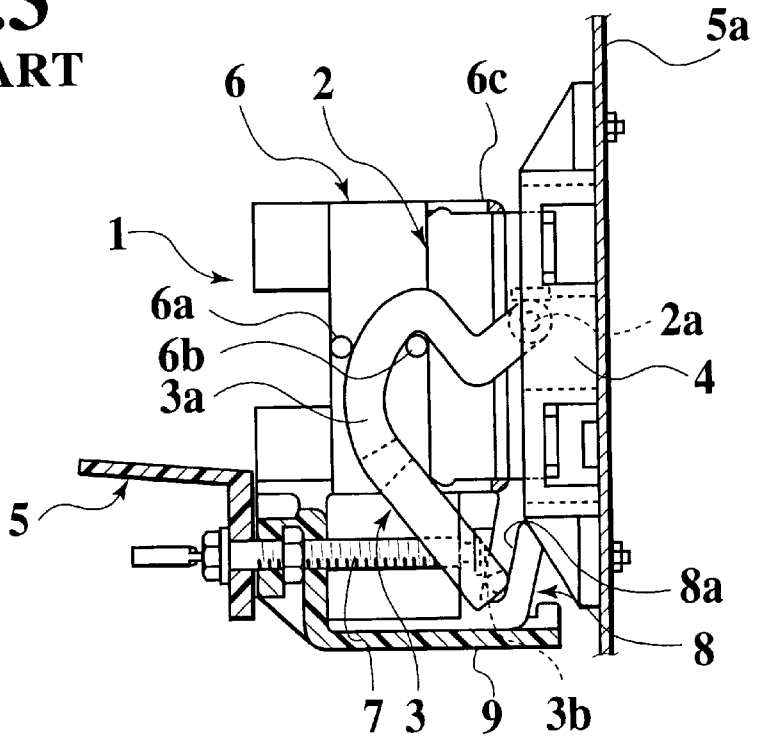
FIG.3 PRIOR ART
FIG. 3 is a side view illustrating partly in section a completely interfitted state between the male and female connector housings of the conventional connector structure.
Figure 4:
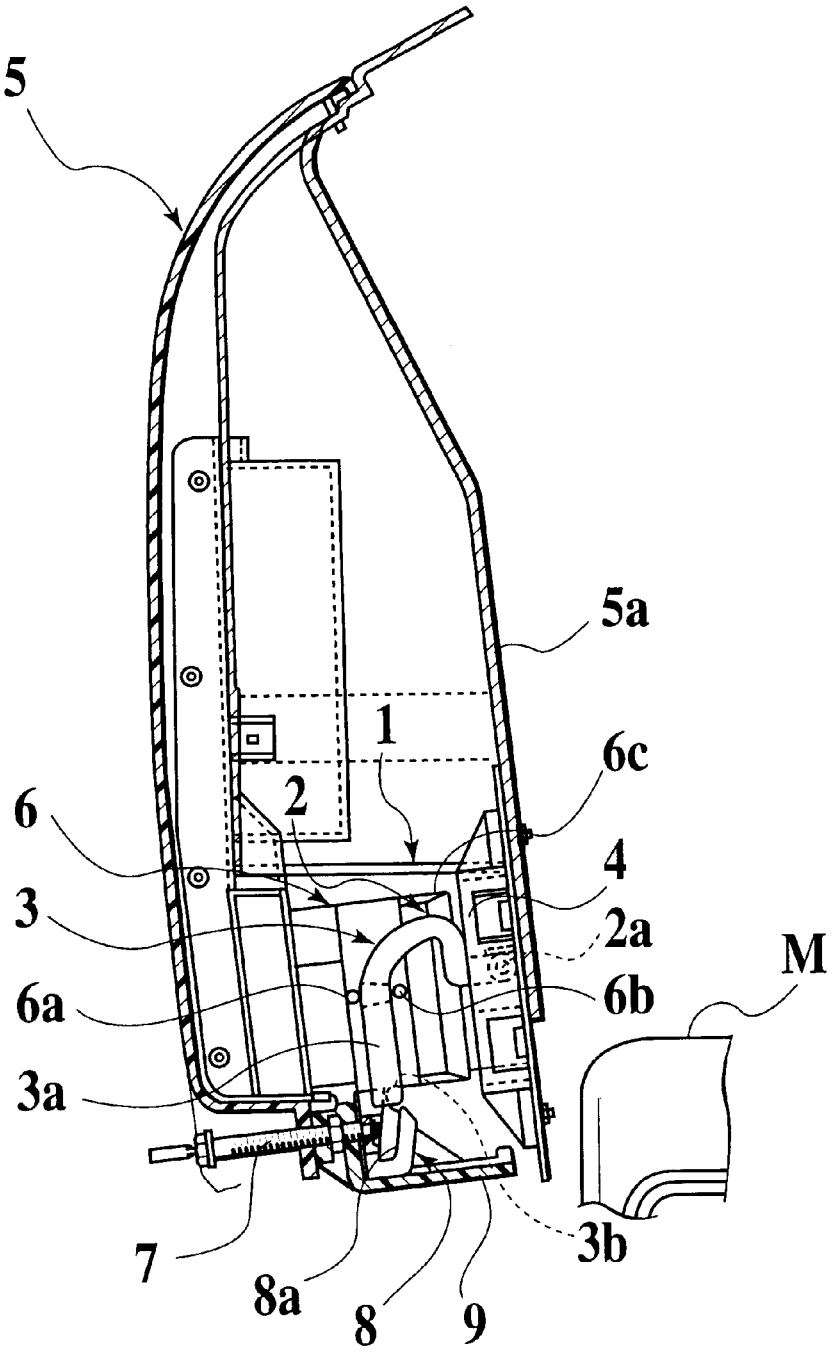
FIG.4 PRIOR ART
FIG. 4 is a side view illustrating partly in section a state where the conventional connector has been mounted within an instrument panel of a vehicle.

There will be detailed below the preferred embodiments of the present invention with reference to the accompanying drawings. Like members are designated by like reference characters.

Figure 5:
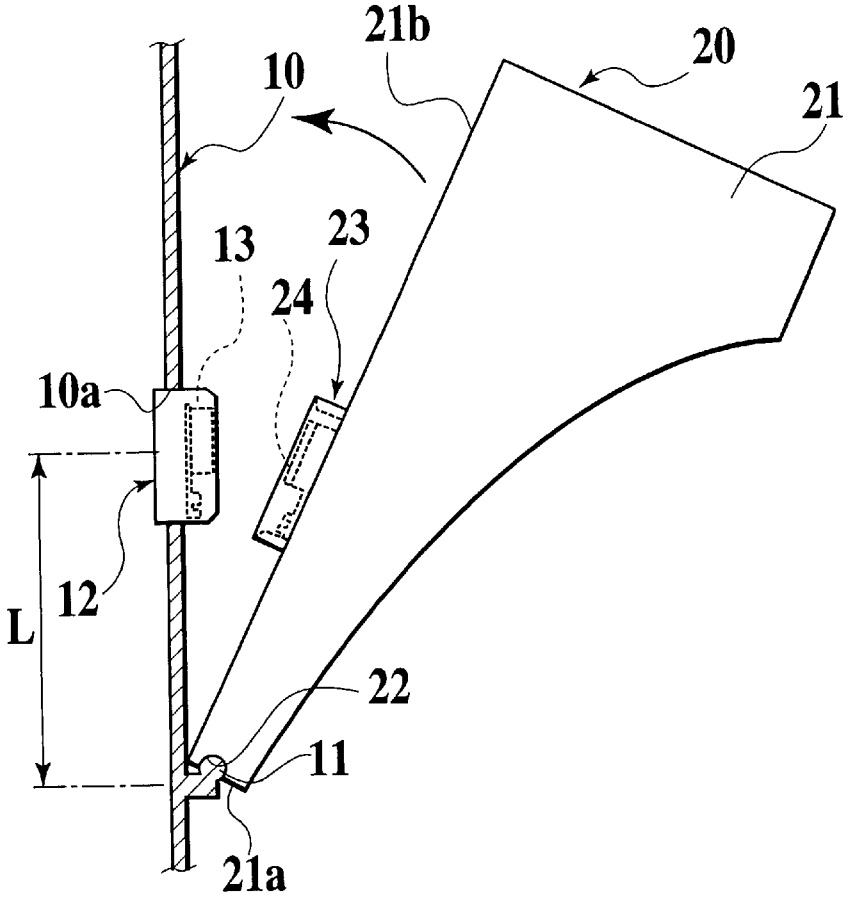
FIG. 5 is a side view illustrating partly in section a state prior to interfitting of both connectors of an instrument panel and a meter to each of which a connector structure according to an embodiment of the present invention is applied.
Figure 6:
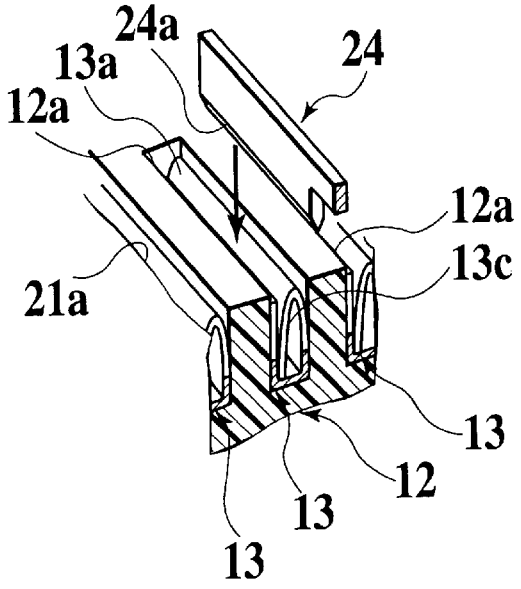
FIG. 6 is a perspective view illustrating partly in section the connector structure.
Figure 7:
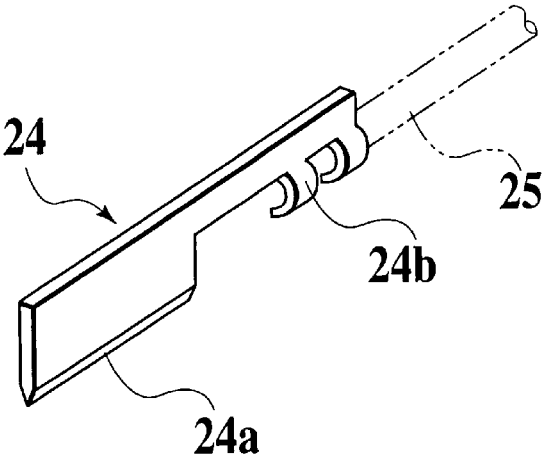
FIG. 7 is a perspective view illustrating a male terminal used in the connector structure.
Figure 8:
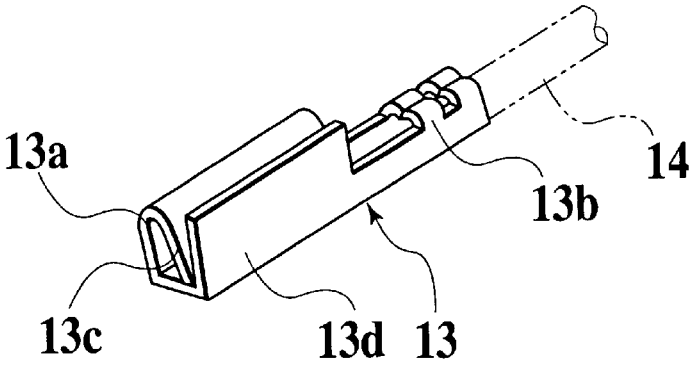
FIG. 8 is a perspective view illustrating a female terminal used in the connector structure.
Figure 9:
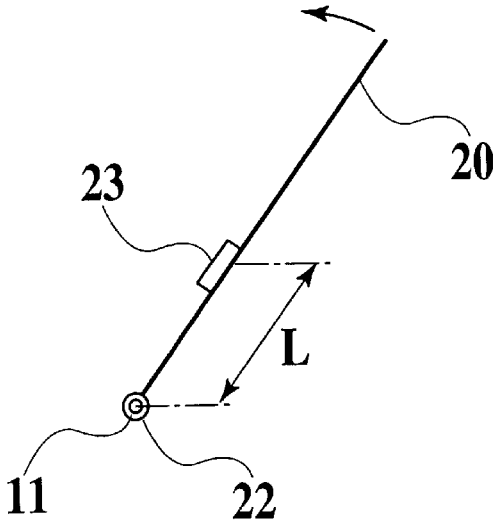
FIG. 9 is an explanatory view illustrating the role as a lever function played by the meter of the connector structure.

FIG. 5 is a side view illustrating partly in section a state prior to interfitting of both connectors of an instrument panel and a meter (gauge board) to each of which a connector structure according to an embodiment of the present invention is applied; FIG. 6 is a perspective view illustrating partly in section the connector structure; FIG. 7 is a perspective view illustrating a male terminal used in the connector structure; FIG. 8 is a perspective view illustrating a female terminal used in the connector structure; and FIG. 9 is an explanatory view illustrating the role as a lever function played by the meter of the connector structure.

As illustrated in FIG. 5, on an on-vehicle instrument panel (a member to be mounted) 10 made of metal there is integrally projectively formed a protruding portion (retaining portion) 11 which serves as a rotating fulcrum when mounting a meter 20 as an electric appliance and extends laterally in the form of a circular column. At a position spaced by a prescribed distance L from the protruding portion 11 of the instrument panel 10 there is formed a laterally elongate rectangular mounting hole 10*a*. To this mounting hole 10*a* there is fixed through prescribed means a male connector (the other connector) 12 so that the male connector may protrude by a prescribed length toward the inside of a vehicle chamber.

As illustrated in FIGS. 5 and 6, the male connector 12 is made of synthetic resin and formed into a rectangular parallelepiped that laterally extends, and has a plurality of terminal accommodation chambers 12*a* formed therein in its left and right directions at equal intervals. In each of the respective terminal accommodation chambers there is accommodated a female terminal (the other terminal) 13 in such a way that the draw-off thereof is being prevented. As illustrated in FIG. 8, each female terminal 13 has a horizontally thrown U shaped forward end portion 13*a* and a caulking portion 13*b* for causing pressure bond connection of an electric wire 14. The forward end portion 13*a* has therein a bent elastic piece 13*c* prepared by bending one side piece thereof inwardly in the form of a letter U. And, it is arranged that between the bent elastic piece 13*c* within the horizontally thrown U shaped forward end portion 13*a* of each female terminal 13 and the other side piece 13*d* of the forward end portion 13*a* there is inserted from an opening side at a frontal surface thereof a forward sharpened portion 24*a* of a male terminal 24 whereby the both terminals 13 and 24 are fitted together and contacted with each other. It is to be noted that the electric wires 14 having been connected to the respective female terminals 13 by pressure bond are bundled together to thereby constitute a wire harness not illustrated.

As illustrated in FIG. 5, a meter casing 21 of the meter 20 is made of synthetic resin and substantially formed into a box configuration. At a position, opposed to the protruding portion 11 of the instrument panel 10, on a rear side of a bottom surface 21*a* of the meter casing 21 there is integrally formed a recessed portion (engaging portion) 22 engaged with the protruding portion 11 and rotatably supported thereby. Also, at a position, opposed to the male connector 12, of a rear surface 21*b* of the meter casing 20 there is integrally projectively formed a female connector (one connector) 23 whose front side is open and which is shaped into a box.

At positions, opposed to the respective female terminals 13 of the male connector 12, of the box-shaped female connector 23 on the rear surface 21*b* side of the meter casing 21 there are respectively provided in an erected way male terminals (one terminals) 24. As illustrated in FIG. 7, each male terminal 24 is formed substantially into a plate configuration having on its lower end (one end) side a forward sharpened portion 24*a* shaped like a letter V in cross section and has on its base end side a caulking portion 24*b* for causing pressure bond connection of an electric wire 25. And, it is arranged that when the female connector 23 and male connector 12 are interfitted with each other, each male terminal 24 is electrically connected to a corresponding one of the female terminals 13 of the male connector 12 by being contacted therewith.

According to the connector structure of the above-described embodiment, at the time of mounting the meter 20 onto the instrument panel 10, when as indicated by an arrow in FIG. 5 the meter 20 is rocked toward the instrument panel 10 side by using the protruding portion 11 of the instrument panel 10 as a fulcrum, the box-shaped female connector 23 of the meter 20 side is fitted to the male connector 12 of the instrument panel 10 side. At this time, the forward sharpened portion 24*a* of each male terminal 24 of the female connector 23 is inserted between the bent elastic piece 13*c* within the horizontally thrown U shaped forward end portion 13*a* of the corresponding female terminal 13 of the male connector 12 and the other side piece 13*d* of the forward end portion 13*a* from the opening side at the frontal surface thereof, whereby the female terminal 13 of the male connector 12 and the male terminal 24 of the female connector 23 are contacted with each other and electrically connected to each other.

In this way, when mounting the meter 20 onto the instrument panel 10, the meter 20 is rocked toward the instrument panel 10 side by using the protruding portion 11 of the instrument panel 10 as a fulcrum to thereby cause the female connector 23 of the meter 20 and the male connector 12 on the instrument panel 10 side to be freely interfittable with each other and as a result as illustrated in FIG. 9 the meter 20 itself plays the role as a lever function and this enables the both connectors 12 and 23 to be easily fitted to each other with a small force with the use of no spacial assisting mechanism and, even when the connectors are multipolar connectors 12 and 23, enables them to be easily and reliably fitted to each other. Especially, the nearer the mounting position of the both connectors 12 and 23 to the fulcrum side, with the smaller force the both connectors 12 and 23 can be interfitted with each other.

Also, since it is sufficient to provide the protruding portion 11 serving as the rotating fulcrum on the instrument panel 10 and to provide in the meter 20 the recessed portion 22 engaged with and supported by the protruding portion 11 and there is no possibility that these elements will be largely protruded, it is possible to simplify and miniaturize the entire connector structure and reduce the number of the parts used and achieve the cost reduction compared to the case using the conventional lever.

Further, when inserting the lower end side of each male terminal 24 of the female connector 23 of the meter 20 side from the opening side of the horizontally thrown U shaped forward end portion 13*a* of the corresponding female terminal 13 of the male connector 12 of the instrument panel 10 side to thereby cause the male terminal 24 to be contacted between the bent elastic piece 13*c* within the forward end portion 13*a* of the female terminal 13 and the other side piece 13*d*, it is possible to smoothly insert the male terminal 24 into the forward end portion 13*a* of the female terminal 13 through the forward sharpened portion 24*a* of the male terminal 24 and, after contact therebetween, to reliably maintain the state of contact between the both terminals 13 and 24 by the elastic urging force of the bent elastic piece 13*c*.

Additionally, although according to the above-described embodiment the instrument panel has been used as the member to be mounted and the meter (gauge board) has been used as the electric appliance, another panel and an appliance may of course be used in a combined form. Also, although an explanation has been given, as the female terminal 13 and male terminal 24, of the terminals that are connected together by pressure bond, the terminal is not limited to the pressure bond terminal and of course permits the use of a pressure contact terminal or a terminal mounted onto, for example, a substrate.

While preferred embodiments of the present invention have been described using specific terms, such description is for illustrative purposes, and it is to be understood that changes and variations may be made without departing from the spirit or scope of the following claims.

What is claimed is:

1. A connector structure, comprising:

an electric appliance;

an instrument panel for mounting the electric appliance;

a first connector provided on the electric appliance;

a second connector provided on the instrument panel;

a retaining portion provided on the instrument panel, the retaining portion serving as a rotating fulcrum when the electric appliance is mounted to the instrument panel; and an engaging portion provided at a position of the electric appliance opposing the retaining portion, the engaging portion supported by the retaining portions wherein the second connector is located at a position spaced by a prescribed distance from the retaining portion of the instrument panel, the first connector being provided at a position of the electric appliance opposing the second connector so that upon rotation of the electric appliance about the retaining portion to mount the electric appliance to the instrument panel, terminals of the first connector and terminals of the second connector are freely contactable with each other, the physical contact between the terminals of the first connector and the terminals of the second connector providing sufficient force to maintain the connection between the electric appliance and instrument panel.

2. The connector structure of claim 1, wherein the terminals of the first connector comprise a plurality of parallel male contact members.

3. The connector structure of claim 2, wherein each parallel male contact member is substantially plate-shaped with a sharpened portion on one side thereof.

4. The connector structure of claim 3, wherein the terminals of the second connector comprise a plurality of parallel female contact members, each female contact member having a U-shaped portion, wherein the sharpened portion of each male contact member contacts the U-shaped portion of the corresponding female contact member upon mounting of the electric appliance onto the instrument panel.

5. The connector structure of claim 4, wherein each terminal of the second connector further comprises a side plate contact member, the sharpened portion of each male terminal contact member being positioned between the side plate and the U-shaped portion upon mounting of the electric appliance to the instrument panel.

6. The connector structure of claim 4, wherein the first connector further comprises a plurality of terminal accommodating chambers, each terminal accommodating chamber having a rectangular slot defining a space for the female contact member.

7. A connector structure for a vehicle, comprising:

a meter casing;

a meter positioned on the meter casing;

a vehicle instrument panel for mounting the meter casing on a portion thereof, the mounting portion of the said instrument panel being substantially plate-shaped;

a first connector provided on the meter casing;

a second connector provided on the mounting portion of the instrument panel;

a retaining portion provided on the instrument panel, the retaining portion serving as a rotating fulcrum when the meter casing is mounted to the instrument panel; and an engaging portion provided at a position of the meter casing opposing the retaining portion, the engaging portion supported by the retaining portion, wherein the second connector is located at a position spaced by a prescribed distance from the retaining portion of the instrument panel, the first connector being provided at a position of the meter casing opposing the second connector so that upon rotation of the meter casing about the retaining portion to mount the meter casing to the instrument panel, terminals of the first connector and terminals of the second connector are freely contactable with each other, the physical contact between the terminals of the first connector and the terminals of the second connector providing sufficient force to maintain the connection between the meter casing and instrument panel.

8. The connector structure of claim 7, wherein the terminals of the first connector comprise a plurality of parallel male contact members.

9. The connector structure of claim 8, wherein each parallel male contact member is substantially plate-shaped with a sharpened portion on one side thereof.

10. The connector structure of claim 9, wherein the terminals of the second connector comprise a plurality of parallel female contact members, each female contact member having a U-shaped portion, wherein the sharpened portion of each male contact member contacts the U-shaped portion of the corresponding female contact member upon mounting of the meter casing onto the instrument panel.

11. The connector structure of claim 10, wherein each terminal of the second connector further comprises a side plate contact member, the sharpened portion of each male terminal contact member being positioned between the side plate and the U-shaped portion upon mounting of the meter casing to the instrument panel.

12. The connector structure of claim 10, wherein the first connector further comprises a plurality of terminal accommodating chambers, each terminal accommodating chamber having a rectangular slot defining a space for the female contact member.

* * * * *

UNITED STATES PATENT AND TRADEMARK OFFICE

CERTIFICATE OF CORRECTION

PATENT NO. : 6,083,027
DATED : July 4, 2000
INVENTOR(S) : Sato

It is certified that error appears in the above-identified patent and that said Letters Patent is hereby corrected as shown below:

Claim 1, Column 6,
Line 11, "retaining portions" should read -- retaining portion, --; and insert a line break before "wherein".

Signed and Sealed this

Twenty-eighth Day of August, 2001

*Attest:*

Nicholas P. Godici

*Attesting Officer*

NICHOLAS P. GODICI
*Acting Director of the United States Patent and Trademark Office*